US011069333B2

(12) United States Patent
Samuelsson et al.

(10) Patent No.: US 11,069,333 B2
(45) Date of Patent: Jul. 20, 2021

(54) ACTIVE NOISE CONTROL METHOD AND SYSTEM USING VARIABLE ACTUATOR AND SENSOR PARTICIPATION

(71) Applicant: Faurecia Creo AB, Linköping (SE)

(72) Inventors: Fredrik Samuelsson, Borensberg (SE); Peter Davidsson, Furulund (SE)

(73) Assignee: Faurecia Creo AB, Linköping (SE)

( * ) Notice: Subject to any disclaimer, the term of this patent is extended or adjusted under 35 U.S.C. 154(b) by 0 days.

(21) Appl. No.: 16/964,368

(22) PCT Filed: Jan. 21, 2019

(86) PCT No.: PCT/EP2019/051350

§ 371 (c)(1),
(2) Date: Jul. 23, 2020

(87) PCT Pub. No.: WO2019/145250

PCT Pub. Date: Aug. 1, 2019

(65) Prior Publication Data

US 2021/0035547 A1 Feb. 4, 2021

(30) Foreign Application Priority Data

Jan. 24, 2018 (SE) ..... 1850077-7

(51) Int. Cl.
*G10K 11/178* (2006.01)

(52) U.S. Cl.
CPC .. *G10K 11/17854* (2018.01); *G10K 11/17815* (2018.01); *G10K 11/17817* (2018.01);
(Continued)

(58) Field of Classification Search
CPC ..... G10K 11/17854; G10K 11/17823; G10K 11/17881; G10K 2210/1282;
(Continued)

(56) References Cited

U.S. PATENT DOCUMENTS 5,226,016 A 7/1993 Christman
5,332,061 A * 7/1994 Majeed ..... B60K 5/1283 180/312

(Continued)

FOREIGN PATENT DOCUMENTS

DE 102015214134 A1 2/2017
EP 0684594 A2 11/1995

(Continued)

OTHER PUBLICATIONS

Montazeri, Allahyar, et al., "Developing an IIR Robust Adaptive Algorithm in the Modified Filtered-x RLS Form for Active Noise and Vibration Control Systems", Dec. 2011, DOI: 10.1109/CDC2011.6161 in the proceedings of: 50th IEEE Conference on Decision and Control and European Control Conference. (Year: 2011).*

(Continued)

*Primary Examiner* — Kile O Blair
(74) *Attorney, Agent, or Firm* — Kagan Binder, PLLC

(57) ABSTRACT

A method for reducing noise in at least one monitor position in a vehicle compartment by actively controlling the power of a primary noise ($d_m(t)$) as sensed at two or more control positions in the vehicle compartment, the method comprising the updating of filter coefficient(s) of (an) adaptive filter(s) (w(n)) based on variable contribution of error sensors and actuator(s) for different noise source operating conditions.

15 Claims, 3 Drawing Sheets

(52) U.S. Cl.
CPC ..... *G10K 11/17883* (2018.01); *G10K 2210/1282* (2013.01); *G10K 2210/3012* (2013.01); *G10K 2210/3028* (2013.01)

(58) Field of Classification Search
CPC ..... G10K 11/178; G10K 11/17817; G10K 11/17825; G10K 11/17883; G10K 2210/3023; G10K 2210/30232; G10K 2210/30391
See application file for complete search history.

(56) References Cited

U.S. PATENT DOCUMENTS

| | | | |
|---|---|---|---|
| 5,359,662 | A | 10/1994 | Yuan et al. |
| 5,689,572 | A | 11/1997 | Ohki et al. |
| 6,665,410 | B1 | 12/2003 | Parkins |
| 9,704,471 | B1 | 7/2017 | Ku |
| 2001/0048740 | A1 | 12/2001 | Zhang et al. |
| 2002/0097884 | A1 | 7/2002 | Cairns |
| 2002/0117579 | A1 | 8/2002 | Kotoulas et al. |
| 2008/0192954 | A1 | 8/2008 | Honji et al. |
| 2010/0098263 | A1 | 4/2010 | Pan et al. |
| 2010/0124337 | A1 | 5/2010 | Wertz et al. |
| 2010/0226501 | A1 | 9/2010 | Christoph |
| 2011/0305347 | A1 | 12/2011 | Wurm |
| 2012/0177221 | A1 | 7/2012 | Christoph |
| 2016/0093283 | A1 | 3/2016 | Kano |
| 2016/0314778 | A1 | 10/2016 | Christoph et al. |
| 2017/0178617 | A1 | 6/2017 | Christoph et al. |

FOREIGN PATENT DOCUMENTS

| | | | |
|---|---|---|---|
| EP | 2420411 | A1 | 2/2012 |
| EP | 2597638 | A1 | 5/2013 |
| WO | 2017157595 | A1 | 9/2017 |
| WO | 2017157669 | A1 | 9/2017 |

OTHER PUBLICATIONS

International Search Report for International Application No. PCT/EP2019/051350, dated Apr. 24, 2019 (15 pages).
International Search Report for International Application No. PCT/EP2018/082980, dated Apr. 1, 2019 (15 pages).
Swedish Office Action and Search Report for Swedish Application No. 1850077-7, dated Sep. 7, 2018, (8 pages).
Second Swedish Office Action for Swedish Application No. 1850077-7, dated Feb. 22, 2019, (6 pages).
Third Swedish Office Action for Swedish Application No. 1850077-7, dated Jun. 4, 2020, (4 pages).
Swedish Search Report for Swedish Application No. 1751476-1, dated Jun. 11, 2018, (3 pages).
Huang et al., "Improvement of audio noise reduction system based on RLS algorithm", Proceedings of 2013 3rd International Conference on Computer Science and Network Technology, pp. 964-968, 2013, (5 pages).
Kahrs et al., "The past, present and future of audio signal processing" IEEE Signal Processing Magazine, vol. 14, Issue 5, pp. 30-57, 1997, (28 pages).
Kuo et al., "Active noise control: A tutorial review" Proceedings of the IEEE, vol. 87, No. 6, pp. 943-973, 1999, (31 pages).
E-Space English Abstract for DE 102015214134 A1.

* cited by examiner

ACTIVE NOISE CONTROL METHOD AND SYSTEM USING VARIABLE ACTUATOR AND SENSOR PARTICIPATION

CROSS-REFERENCE TO RELATED APPLICATIONS

This application claims priority to International Application No. PCT/EP2019/051350, filed Jan. 21, 2019 and titled "ACTIVE NOISE CONTROL METHOD AND SYSTEM USING VARIABLE ACTUATOR AND SENSOR PARTICIPATION," which in turn claims priority from a Swedish Patent Application having serial number 1850077-7, filed Jan. 24, 2018, titled "ACTIVE NOISE CONTROL METHOD AND SYSTEM USING VARIABLE ACTUATOR AND SENSOR PARTICIPATION," both of which are incorporated herein by reference in their entireties.

TECHNICAL FIELD

The present disclosure relates to a method and system for reducing noise in a vehicle compartment using variable actuator and sensor participation.

BACKGROUND OF THE INVENTION

In a motor vehicle disturbing sound (noise) may be radiated into the vehicle compartment generated by mechanical vibrations of the engine or components mechanically or acoustically coupled thereto (e.g., a fan), wind passing over and around the vehicle, tires contacting, for example, a paved surface, or propeller waves exciting the walls of the aircraft fuselage.

Active noise control (ANC) systems and methods are known that, in particular for lower frequency ranges, eliminate or at least reduce such noise radiated into the vehicle compartment.

The basic principle of common ANC systems is to introduce secondary sound sources in the vehicle compartment so as to provide an opposite-phase image, secondary sound field, of the noise, the primary sound field. The degree to which the secondary sound field matches the primary sound field determines the effectiveness of an ANC system. If the primary and secondary sound fields were matched exactly, both in space and time, the noise would be completely eliminated.

In practice, such match cannot be made perfect, and this mismatch limits the degree of noise control which can be achieved.

Modern ANC systems implement digital signal processing and digital filtering techniques. Typically, reference sensors (e.g., analogue sensors like accelerometers or microphones) are used to provide electrical reference signals representing the disturbing noise sources in the compartment. Alternatively, non-acoustical sensors like tachometers could be used and synthetically generate the necessary reference signals. The one or more reference signals are fed through adaptive filters, and supplies drive signals to actuators (e.g., loudspeakers or shakers), the secondary sound sources. The actuators generate secondary sound waves, aiming at having amplitude and phase opposite to that of the primary sound waves in the compartment. The secondary sound waves interact with the primary sound waves, thereby eliminating or at least reducing the disturbing noise within the compartment. Residual noise in the compartment is sensed using error sensors. The resulting error sensor output signals are used as "error signals" and are provided to an adaptive algorithm, wherein the filter coefficients of the adaptive filters are modified such that a cost function (e.g., norm or the power of the error signal) and, thereby, the residual noise in the compartment is minimized.

The performance of an ANC system is largely dependent on the configuration of actuators and error sensors used in the ANC system, i.e. the location of sensors and actuators in the compartment. It is, hence, important to optimize the location of sensors/actuators to minimize residual noise in the compartment for different disturbing noise sources. In many cases there are different optimal solutions for different operating conditions, where operating conditions may include e.g. motor speed, engine thrust, speed, propeller speed. It may be difficult to find one ANC system configuration which is optimal for all operating conditions.

There is therefore a need for an ANC system having a configuration which is possible to adapt and optimize to different operating conditions.

SUMMARY OF THE INVENTION

It is an object of the present disclosure to provide an active noise control method which is possible to adapt and optimize for different operating conditions.

It is also an object to provide an improved active noise control system.

The invention is defined by the appended independent claims. Embodiments are set forth in the dependent claims, in the attached drawings and in the following description.

According to a first aspect there is provided a method for reducing noise in at least one monitor position in a vehicle compartment by actively controlling the power of primary noise as sensed at two or more control positions in the vehicle compartment, the primary noise originating from a noise source transmitting noise through a respective primary path to the respective control position. The method comprises arranging at least one actuator in the compartment, arranging an error sensor in each control position, arranging at least one adaptive filter per actuator, and arranging an adaptive algorithm unit providing updated filter coefficients to the at least one adaptive filter. Further, arranging at least one reference sensor providing a reference signal, coherent with the noise from the noise source, to the at least one adaptive filter and to the adaptive algorithm unit, applying the at least one adaptive filter to the reference signal to provide and transmit a drive signal to its respective actuator, and arranging the at least one actuator to, as a response to the drive signal, provide and transmit a respective secondary noise through a respective secondary path between the actuator and the respective control position arriving at the respective control position as a respective secondary anti-noise. The error sensors are arranged to provide and transmit a respective error signal, representing a sensed residual noise of the sensed primary noise and sensed secondary anti-noise, to the adaptive algorithm unit. The method further comprises arranging an actuator and error sensor weighting device to receive signal(s) representing noise source operating condition(s), to determine a set of weighting factors for each actuator and error sensor, respectively, based on the signal(s) representing the noise source operating condition(s), and to transmit the determined set of weighting factors to the adaptive algorithm unit, and arranging the adaptive algorithm unit to, based on the received set of weighting factors, provide updated filter coefficients to the at least one adaptive filter to reduce the power of the residual noise sensed in at least one of the control positions.

The above method is a so called active noise control (or cancellation), ANC, method.

The vehicle may e.g. be a motor vehicle such as a car, a bus, a truck, an aircraft, a boat, a submarine; a heavy vehicle such as a dumper; or a railed vehicle such as a train or a tram.

The noise source may e.g. be an engine, electric motor, a propeller, an air conditioning system, muffler, gearbox, vehicle tires or any combined such noise source.

Noise may, hence, be sound waves or vibrations. Noise is undesirable sound sensed in the compartment.

Noise source operating conditions may be e.g. rotational speed of the motor, propeller speed, vehicle speed, engine power setting or combinations thereof. The registering of signal(s) representing noise source operating conditions may take place continuously. Such signal may be registered using e.g. tachometers or vibration sensors.

A primary path is the acoustic transmission path from the noise source to the error sensor.

The secondary path is the acoustic transmission path between an actuator and error sensor.

Control positions are positions in the compartment where it is possible to install error sensors and in which the power of the primary noise is controlled, e.g. eliminated or at least reduced.

A monitor position is e.g. a position in the compartment where the passenger's ears can be located. Monitor positions are only used in a design phase of the ANC method and are not an active part of the final method. A monitor position is, hence, different from a control position. In a monitor position it is not possible to arrange error sensors during the performance of the method. The aim of the method is to reduce noise in the monitor positions by controlling the power of the primary noise in the control positions.

The number of actuators and error sensors used in the method depends on the application and size of the compartment. The number of error sensors arranged in the compartment are at least two. Preferably, the number of error sensors used in the method should not be less than the number of actuators used in the method. The number of error sensors used in the method may for example be equal to or more than 50% more than the number of actuators used. A typical installation in a car would have between 4 and 6 actuators and between 6 and 10 error sensors.

The position and number of error sensors are carefully selected so as when the noise is controlled in the error sensors the noise is at the same time controlled in monitor positions. Monitor positions are positions in the compartment where it is not possible to install error sensors in the compartment, but where control of the noise is desirable, e.g. position in the vicinity of the ears of a passenger or other positions in the compartment where the noise should be controlled. In a typical application, e.g. in a car, bus or a passenger aircraft, the system comprises several control positions with installed error sensors, the error sensors typically being mounted in interior panels and seats. The monitor positions are typically positions in the compartment where the passenger's ears can be located. The monitor positions are only used in a design phase of the ANC method and are not part of the final method.

The actuators used are arranged to send acoustic signals that reduce the acoustic power in the error sensors used in the method. The error sensors and actuator(s) used in the method may be units specifically arranged and used for the active noise control. Alternatively, they may also be used e.g. by an audio system of the vehicle and/or a hands-free communication system in the vehicle.

The number of adaptive filters per actuator are at least one. Commonly one filter per actuator is used. Sometimes when controlling multiple sources such as road noise, more than one reference signal is used and also the number of adaptive filters increases accordingly.

The at least one actuator may e.g. be a loudspeaker or a shaker.

The error sensor may e.g. be a microphone or an accelerometer.

At a control position a respective error sensor is arranged to sense residual noise, i.e. the sum of the primary noise and a respective secondary anti-noise. The aim of the secondary anti-noise is to be an opposite-phase image of the primary noise in the region you want to control in the compartment. The degree to which a secondary anti-noise matches the primary noise determines the error signal representing the residual noise sensed by an error sensor at a control position, and the degree to which the control positions represents the region in the compartment you want to control determines the ultimate performance of the system. If the primary noise and a secondary anti-noise were matched exactly, both in space and time, the primary noise would be completely eliminated.

The reference signal, coherent with the noise from the noise source, is provided by a reference sensor. For periodic noise sources the reference sensor may be a non-acoustic sensor like e.g. the firing pulse of a combustion engine or rotational speed sensor of a rotating machinery etc. The reference signal is then synthetically reproduced from this signal sensing the frequency and phase angle of the periodic noise source. The reference signal(s) may be sensed directly by an analogue sensor(s), e.g. accelerometer, microphone, strain gauge etc. Alternatively, the reference signal(s) may be produced from a combination of reference signals.

A distribution of actuators and error sensors in the compartment may be spatially optimal for a given primary noise, but may not be optimal when the noise source operating condition(s) change. For example, when the rpm changes there is a change of condition(s) which may cause a different spatial distribution of the primary noise in the compartment. In such case, using a different spatial distribution of actuators and error sensors may improve the performance of the method.

With the present method, signals representing noise source operating conditions are received by the actuator and error sensor weighting device, and based on the signals weighting factors are determined for each actuator and error sensor to reduce the error signal(s), the power of the residual noise, i.e. the power of the sum of the sensed primary noise and secondary noise, sensed in the control positions.

The weighting factor is a factor that determines the contribution of an actuator or an error sensor in the method. That is, rather than each error sensor/actuator contribute equally in the reduction of the power of the primary noise sensed at a control position in the compartment, some are adjusted to contribute more than others and sometimes actuators/error sensors may be switched off.

The weighting factors are variable depending on different noise source operating conditions.

A weighting factor for an actuator/error sensor may vary between zero and a number that grades the actuator/error sensors importance at different operating conditions. The weighting factors may be determined by an optimization process in the design phase of the ANC method. In such a design phase the results from different actuator and error sensor combinations and different operating conditions have been measured and simulated.

The updating of the filter coefficient(s) of the at least one adaptive filter is a continuous and iterative process where the update is performed in steps and where the update is based on the variable weighting factors. The updating of the filter coefficient(s) is, hence, based on variable contribution of error sensors and actuator(s) for different noise source operating conditions. Thereby achieving optimal spatial alignment of actuators/error sensors for different noise source operating conditions.

The adaptive algorithm unit may comprise a filter update device, a filtering and weighting device arranged to filter the reference signal with a respective secondary path digital model of the respective secondary path, update the filtered reference signal based on the received set of weighting factors, and to transmit the filtered and weighted reference signal to the filter update device, and an error sensor weighting device. The error sensor weighting device may be arranged to determine respective weighted error signals by applying respective error sensor weighting factors to the respective error sensor signal, and to transmit the weighted error signal(s) the to the filter update device. The filter update device may be arranged to update the filter coefficients of the adaptive filter step wise by an iterative process using the expression:

$$w_k(n+1) = (1-\mu\gamma_k)w_k(n) - \mu\sum_{m=1}^{M} x'_{km}(n)e'_m(n)$$

wherein

μ is the step size k represents the $k^{th}$ actuator m represents the $m^{th}$ error sensor $w_k(n)$ is a vector containing the current set of filter coefficients $w_k(n+1)$ is a vector containing the updated set of filter coefficients $x'_{km}(n)$ is a vector containing a time history of the weighted and filtered reference signal x(n).

$e'_m(n)$ is the weighted error signal from the $m^{th}$ error sensor.

$\mu\gamma_k$ is the leakage factor.

A secondary path digital model represents transfer functions (impulse response functions) between actuators and error sensors. It may be determined offline (when there is no disturbing noise signal) in a calibration step, or online (in presence of the primary noise), through so-called online secondary path modelling techniques. The secondary path may be measured online by sending out sound through the actuators which is masked by the primary background sound.

As a secondary path may be subject to variations during operation of the method, the secondary anti-noise sensed at a control position may also be subject to changes. A faulty model of the transfer function of the secondary path may have a considerable and negative impact on the performance of the active noise control by affecting the convergence behaviour of the adaptive filter, and thus the stability and quality of the behaviour thereof, and also the adaptation speed of the filter.

The weighting factors for the error sensors and actuator(s) for a certain noise source operating condition may be determined from a set of predetermined relationships between signals representing different noise source operating conditions and corresponding predetermined weighting factors.

Predetermined weighting factors may be determined by optimizing the method for various noise source operating conditions. The predetermined weighting factors being stored together with the corresponding signals representing different noise source operating conditions.

The weighting factors for the error sensors and actuator(s) for a certain noise source operating condition may alternatively be determined as a function of predetermined weighting factors and a variable that represents a change of the noise source operating condition(s).

The predetermined weighting factors for the error sensors and actuator(s) for a certain noise source operating condition may be determined from predetermined spatial characteristics of a primary noise field in the compartment and predetermined spatial characteristics of a secondary anti-noise field in the compartment corresponding to a minimal residual noise level in at least one of the monitor positions.

With spatial characteristics is here meant noise pressure distribution in the compartment for a specific noise source operating condition and how this noise pressure distribution is affected by a change in noise source operating conditions.

Spatial characteristics of the primary noise field may be determined by simulations or be measured by performing operational tests, i.e. measurements of the acoustic field in the compartment using an array of error sensors, e.g. microphones, for different noise source operating conditions. Primary noise field measurement can be performed at a design phase of the method.

The secondary anti-noise field may be determined from transfer functions between the actuators and the error sensors weighted by the respective weighting factor and transfer functions between the actuators and monitor positions. Transfer functions may be measured/determined by acoustic measurements at the system design phase.

A residual noise level at a monitor position can be predicted for a given set of weighting factors by summation of the primary noise field and the weighted secondary noise field.

A minimal residual noise level in a monitor position is a noise level in which there is no noise at all, or the minimal noise level that can be obtained at the position.

The determination of the predetermined weighting factors for a certain noise source operating condition may be performed using an algorithm that predicts the residual noise at the at least one monitor position for all possible weighting factors and selects the weighting factors corresponding to the minimal residual noise level at the monitor position(s).

The determination of the weighting factors can be repeated for all noise source operating conditions leading to a list of predetermined weighting factors representing the noise source operating conditions.

The predetermined weighting factors and signals representing different noise source operating conditions may be stored as a lookup table.

The weighting factor for the error sensors and actuator(s) for a certain operating condition may be determined by interpolation of stored weighting factors.

Said interpolation may be a linear interpolation, quadratic interpolation or other types of curve fitting.

(A) signal(s) representing the noise source operating condition(s) may be extracted from a computer bus/network of the vehicle, from a tachometer signal, from one or more error sensors used in the method, from one or more vibration sensors, or from the reference signal.

The bus may e.g. be a CAN-bus, MOST-bus or equivalent.

The adaptive algorithm unit may apply the weighting factors to an LMS algorithm selected from a group comprising filtered-reference-LMS, leaky-filtered-reference-LMS, filtered-error-LMS, leaky-filtered-error-LMS, normalized-filtered-reference-LMS and normalized-leaky-filtered-reference-LMS.

The adaptive algorithm unit may apply the weighting factors to an RLS algorithm selected from a group comprising filtered-reference-RLS, leaky-filtered-reference-RLS, normalized-filtered-reference-RLS and normalized-leaky-filtered-reference-RLS.

The reference signal may be filtered with an adaptive FIR-filter as:

$$y_k(n)=w_k^T(n)x(n)$$

where $$x(n)=[x(n)\ x(n-1)\ \ldots\ x(n-L_w+1)]^T$$

$$w_k(n)=[w_{k,0}(n)\ w_{k,1}(n)\ \ldots\ w_{k,L_w-1}(n)]^T$$

where $L_W$ is the number of coefficients of the adaptive filter and n is the current time step.

The reference signal may alternatively be filtered using IIR filters.

According to a second aspect there is provided an active noise control system for reducing noise in at least one monitor position in a vehicle compartment by active control of the power of primary noise as sensed at two or more control positions in the vehicle compartment, the primary noise originating from a noise source transmitting noise through a respective primary path to the respective control position. The system comprises at least one actuator arranged in the compartment, an error sensor arranged in each control position, at least one adaptive filter arranged per actuator, an adaptive algorithm unit arranged to provide updated filter coefficients to the at least one adaptive filter, and at least one reference sensor arranged to provide a reference signal, coherent with the noise from the noise source, to the at least one adaptive filter and to the adaptive algorithm unit. The at least one adaptive filter is arranged to be applied to the reference signal to provide and transmit a drive signal to its respective actuator. The at least one actuator is arranged to, as a response to the drive signal, provide and transmit a respective secondary noise through a respective secondary path between the actuator and the respective control position, arriving at the respective control position as a respective secondary anti-noise, and the error sensors are arranged to provide and transmit a respective error signal, representing a sensed residual noise of the sensed primary noise and sensed secondary anti-noise, to the adaptive algorithm unit. The system further comprising an actuator and error sensor weighting device arranged to receive signal(s) representing noise source operating condition(s), to determine a set of weighting factors for each actuator and error sensor, respectively, based on the signal(s) representing the noise source operating condition(s), and to transmit the determined set of weighting factors to the adaptive algorithm unit. The adaptive algorithm unit is arranged to, based on the received set of weighting factors, provide updated filter coefficients to the at least one adaptive filter to reduce the power of the residual noise sensed in at least one of the control positions.

The adaptive algorithm unit may comprise a filter update device, a filtering and weighting device arranged to filter the reference signal with a respective secondary path digital model of the respective secondary path, update the filtered reference signal based on the received set of weighting factors, and to transmit the filtered and weighted reference signal to the filter update device, and an error sensor weighting device arranged to determine respective weighted error signals by applying respective error sensor weighting factors to the respective error sensor signal, and to transmit the weighted error signal(s) the to the filter update device. The filter update device may be arranged to update the filter coefficients of the adaptive filter step wise by an iterative process using the expression:

$$w_k(n+1)=(1-\mu\gamma_k)w_k(n)-\mu\sum_{m=1}^{M}x'_{km}(n)e'_m(n)$$

wherein

μ is the step size k represents the $k^{th}$ actuator m represents the $m^{th}$ error sensor $w_k(n)$ is a vector containing the current set of filter coefficients $w_k(n+1)$ is a vector containing the updated set of filter coefficients $x'_{km}(n)$ is a vector containing a time history of the weighted and filtered reference signal x(n).

$e'_m(n)$ is the weighted error signal from the $m^{th}$ error sensor.

$\mu\gamma_k$ is the leakage factor.

According to a third aspect there is provided a use of the active noise control system described above for reducing the power of residual noise sensed in at least one control position arranged in the compartment of a motor vehicle.

The motor vehicle may be a road vehicle.

The road vehicle may be a car.

The motor vehicle may be an aircraft.

DETAILED DESCRIPTION OF THE DRAWINGS

Figure 1:
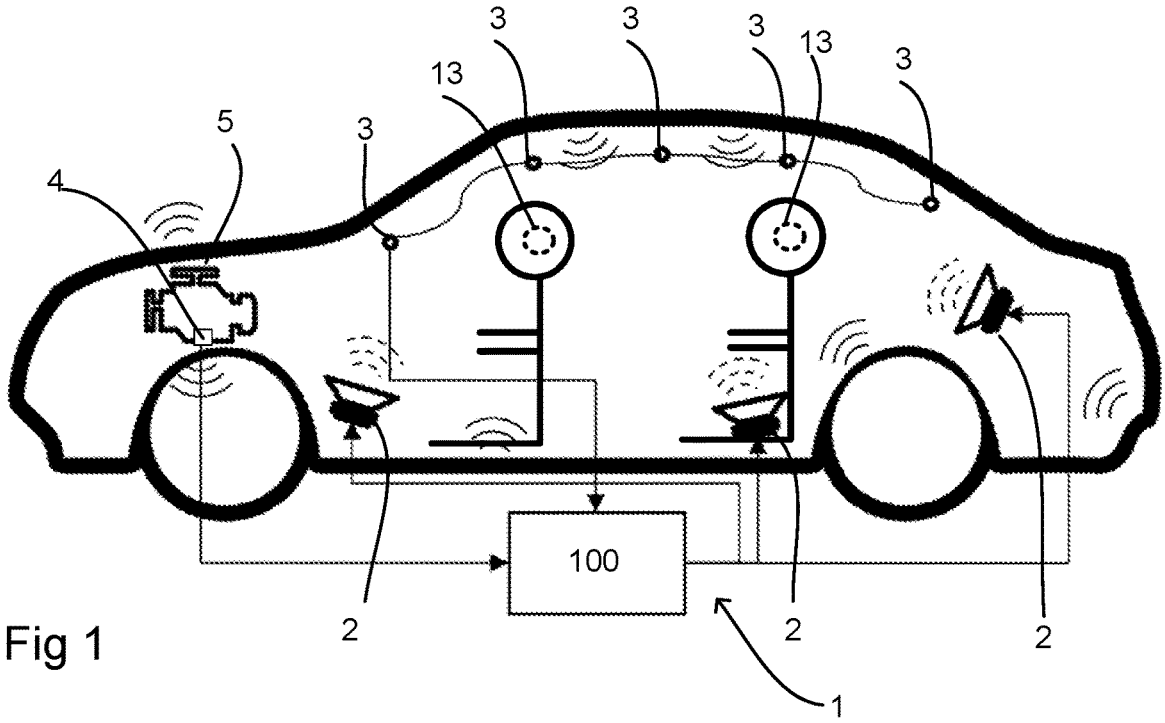
FIG. 1 illustrates an ANC system in a car.

In FIG. 1 is illustrated an active noise control (ANC) system 1 arranged in a car. The system comprises actuators 2, e.g. loudspeakers, and error sensors 3, e.g. microphones, arranged in the car compartment and an ANC controller 100. Such ANC systems may also be arranged in other vehicles such as aircrafts, busses, trains, boats etc.

The ANC system 1/method shown in FIGS. 1-4, may be used to reduce disturbing sound (noise) in at least one monitor position 13 in the compartment by actively controlling the power of primary noise $d_m(t)$ as sensed at two or more control positions in the vehicle compartment. The monitor positions 13 are typically positions in the compartment where the passenger's ears can be located. Control positions are positions in which error sensors 3 may be installed. The primary noise $d_m(t)$ may originate from a noise source 5 transmitting noise x(t) through a respective primary path $P_m$ to the respective control position. Such primary noise may be generated by mechanical vibrations of an engine 5 (as illustrated in FIG. 1) and/or components mechanically or acoustically coupled thereto (e.g., a fan), wind passing over and around the vehicle, and/or tires contacting, for example, a paved surface, propeller noise waves exciting the walls of the passenger compartment.

With the ANC system 1/method the power of primary noise $d_m(t)$ as sensed at the two or more control positions in the vehicle compartment may be actively controlled. The control positions may be positions in the compartment where it is possible to install error sensors 3 and in which the primary noise $d_m(t)$ is controlled, e.g. eliminated or at least reduced.

The ANC system 1/method comprises M error sensors 3, arranged in respective control positions in the compartment. The ANC system should comprise at least two error sensors 3. The system 1 comprises K actuators 2. The number of actuators 2 and error sensors 3 used in the system/method depends on the application and size of the compartment. Preferably, the number of error sensors 3 used should not be less than the number of actuators 2 used.

At least one adaptive filter $w_k(n)$ may be arranged for each actuator 2 and there may be an adaptive algorithm unit 6 arranged to provide updated filter coefficients to the at least one adaptive filter $w_k(n)$.

A reference sensor 4 may be arranged to provide a reference signal x(n), which signal is coherent with the noise x(t) from the noise source 5, to the adaptive filter(s) $w_k(n)$ and to the adaptive algorithm unit 6. The variable n here represents the latest sample of the signals, i.e. x(n) is the latest sample of the time continuous x(t).

The adaptive filter $w_k(n)$ is applied to the reference signal x(n) to provide and transmit a drive signal $y_k(n)$ to its respective actuator 2.

The actuator(s) 2 may be arranged to, as a response to the drive signal $y_k(n)$, provide and transmit a respective secondary noise $y_k(t)$ through a respective secondary path $S_{km}$ between the actuator 2 and the respective control position arriving at the respective control position as a respective secondary anti-noise $y'_m(t)$. The error sensors 3 may be arranged to provide and transmit a respective error signal $e_m(n)$, representing a sensed residual noise $e_m(t)$ of the sensed primary noise and sensed secondary anti-noise, to the adaptive algorithm unit 6.

The aim of the secondary anti-noise $y'_m(t)$ is to be an opposite-phase image of the sensed primary noise $d_m(t)$. The degree to which the secondary anti-noise $y'_m(t)$ matches the primary noise $d_m(t)$ determines the sensed residual noise $e_m(t)$ and the corresponding error signal $e_m(n)$. If the primary noise and the secondary anti-noise were matched exactly, both in space and time, the primary noise would be completely eliminated at the control position and the error signal $e_m(n)$ would be zero in a control position.

An actuator and error sensor weighting device 7 may be arranged to receive signal(s) c(n) representing noise source 5 operating condition(s), e.g. rotational speed of the motor, propeller speed, vehicle speed, engine power setting or combinations thereof. The actuator and error sensor weighting device 7 may also be arranged to determine a set of weighting factors $mp_m(n)$, $kp_k(n)$ for each actuator 2 and error sensor 3 used in the system/method, based on the signal(s) c(n) representing the noise source operating condition(s).

A weighting factor is a factor that determines the contribution of an actuator 2 or error sensor 3 in the system/method. Some of the actuators/error sensors may be adjusted to contribute more than others in the reduction of residual noise $e_m(t)$ sensed in a control position. Sometimes actuators/error sensors may be switched off and not used at all. The weighting factors are variable depending on different noise source operating conditions.

The error sensor weighting device 7 may transmit the determined set of weighting factors to the adaptive algorithm unit 6. The adaptive algorithm unit 6 may be arranged to, based on the received set of weighting factors, provide updated filter coefficients to the at least one adaptive filter $w_k(n)$ to reduce the power of the residual noise $e_m(t)$ sensed in at least one of the control positions.

The updating of the filter coefficient(s) of the at least one adaptive filter $w_k(n)$ may be a continuous and iterative process where the update is performed in steps and where the update is based on the variable weighting factors. The updating of the filter coefficient(s) is, hence, based on variable contribution of error sensors 3 and actuator(s) 2 for different noise source operating conditions. Thereby achieving optimal spatial alignment of actuators/error sensors for different noise source operating conditions.

A distribution of actuators 2 and error sensors 3 in the compartment may be spatially optimal for a given noise disturbance, but may not be adapted when the noise disturbance changes, such as when noise source operating conditions change. In such case, using a different spatial distribution of actuators 2 and error sensors 3 may improve the performance of the method.

To achieve spatial alignment which results in global sound control the error sensors 3 and actuators 2 must be carefully selected. This is done by measurements and optimizations in the design phase of the ANC system/method for a specific vehicle. To determine which sensors 3 and actuators 2 give the best global control steady-state simulations are performed for many different combinations of actuators 2 and sensors 3. The number of possible combinations in such optimization depends on selected system size and number of possible locations to select among. For cavities like in a car or similar it is possible to try all combinations and select the one which gives best global control, i.e. that minimizes the error signals in the whole compartment. However, for cavities in e.g. busses or aircrafts the number of combinations is far too big to be able to try all combinations. In that case optimization algorithms like "random walk" or "simulated annealing" may be used.

Such optimizations will typically find different set of optimal actuators 2 and error sensors 3 depending on type of noise source and operating conditions. For example, when controlling engine noise the optimal set of actuators 2 and sensors 3 depends on engine rotational speed and which engine order that dominates. Traditionally the optimizations have been set up to find one set of actuators 2 and sensors 3 that performs reasonably well at all conditions.

Figure 2:
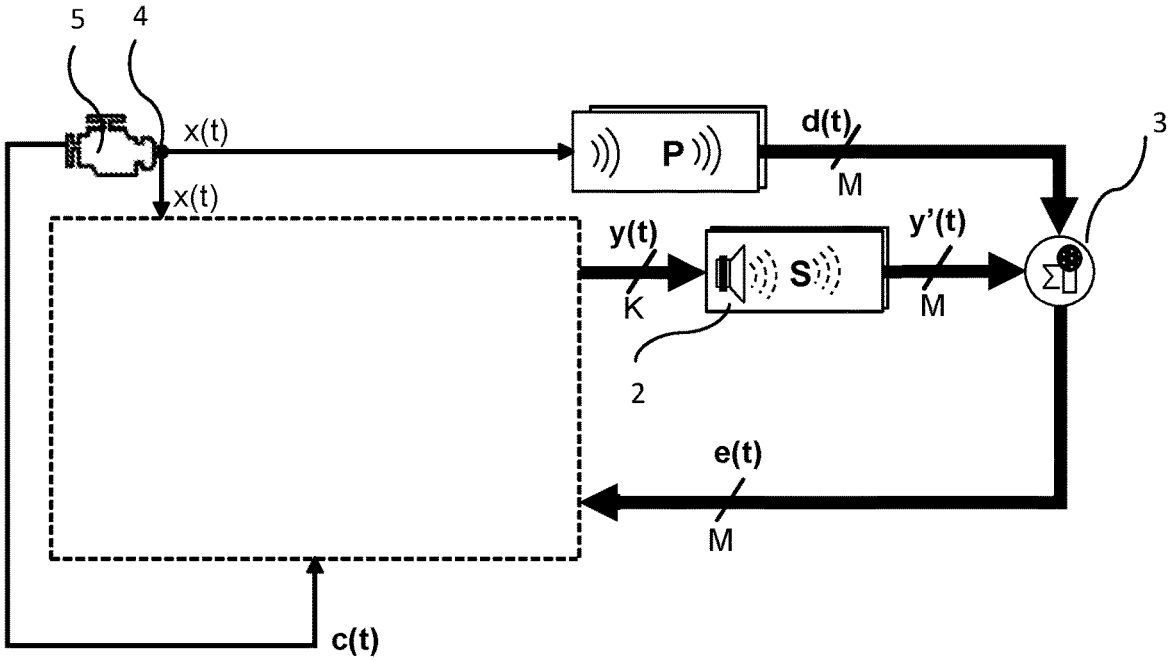
FIG. 2 shows a block scheme of a modified ANC system/method.

In FIG. 2 is shown a simplified block scheme of the ANC system/method discussed above. FIG. 2 illustrates that the method/system uses signal(s) c(t) representing noise source 5 operating condition(s), to update drive signals $y_k(t)$ to the actuators 2, such that the updating thereof is based on variable contribution of error sensors 3 and actuator(s) 2 for different noise source operating conditions. Thereby achieving optimal spatial alignment of actuators/error sensors for different noise source operating conditions.

Figure 5:
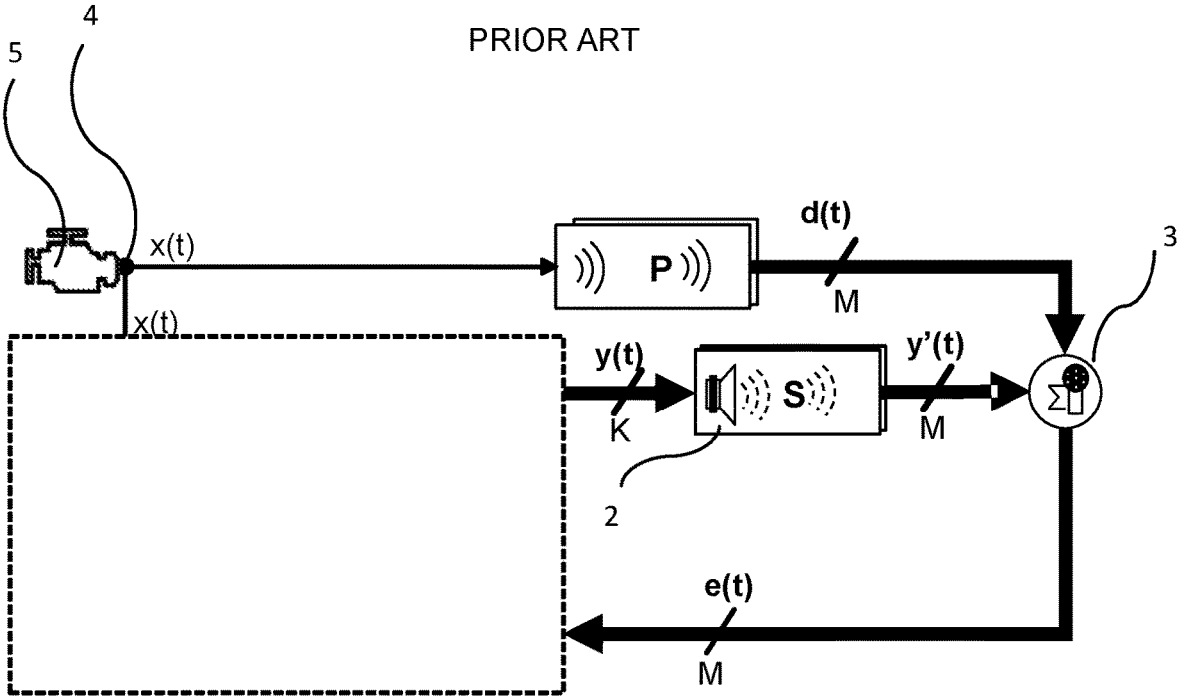
FIG. 5 shows a block scheme of a prior art ANC system/method.

In FIG. 5 is shown a block scheme of common prior art ANC systems/methods in which drive signals $y_k(t)$ to the actuators 2 are only updated based on signals from the reference sensor 4 and error sensors 3.

Figure 3:
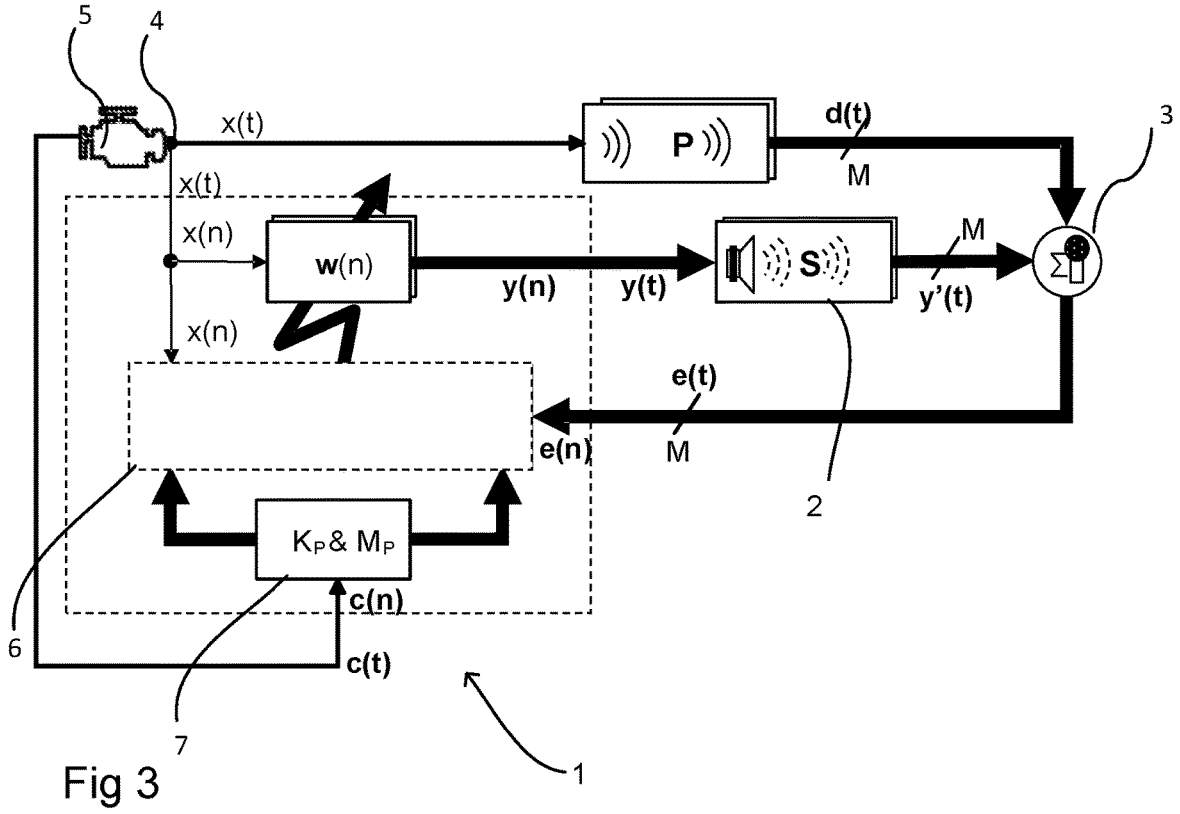
FIG. 3 is a schematic view of the modified ANC system/method of FIG. 2.
Figure 4:
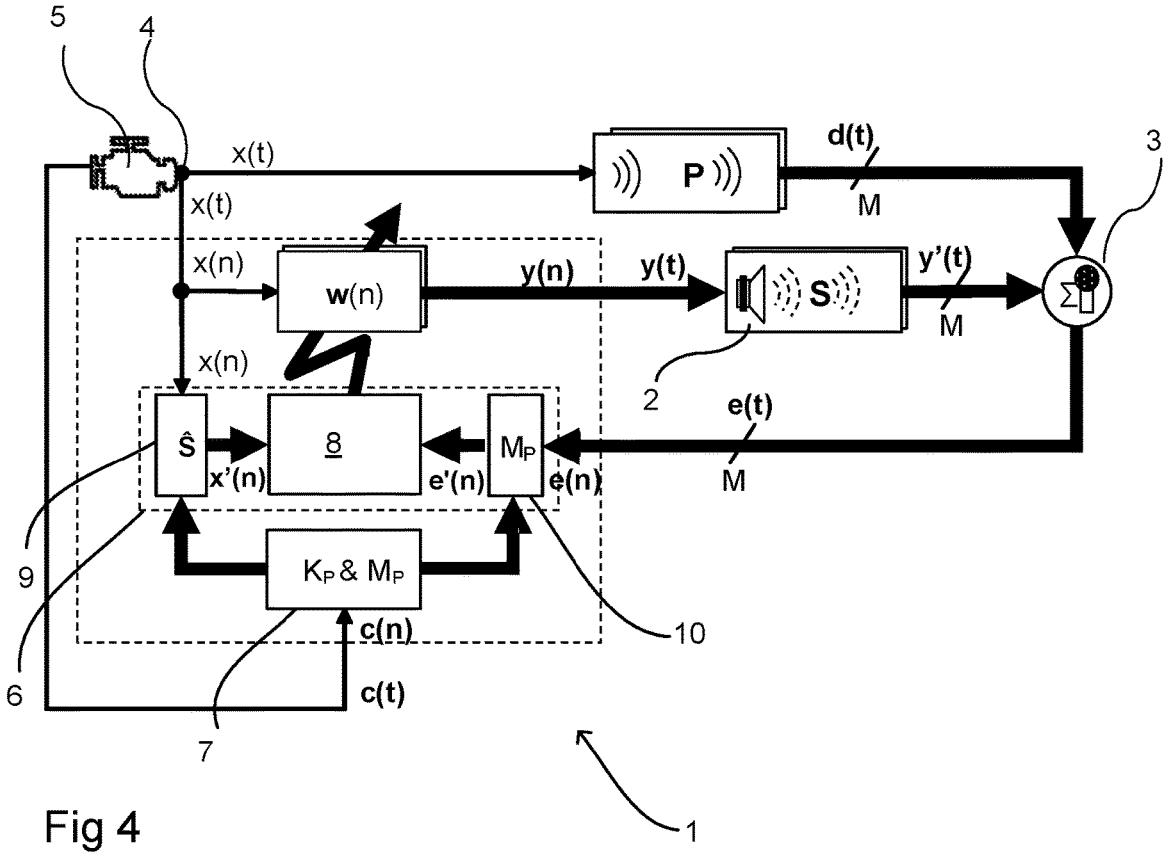
FIG. 4 is a detailed schematic view of the modified ANC system/method of FIG. 2

In FIG. 4 is a more detailed description of the system/method in FIG. 3. As seen in FIG. 4, the adaptive algorithm unit 6 may comprise a filter update device 8, a filtering and weighting device 9 and an error sensor weighting device 10. The filtering and weighting device 9 may be arranged to filter the reference signal x(n) with a respective secondary path digital model $\hat{S}_{km}$ of the respective secondary path $S_{km}$ and to update the filtered reference signal based on the received set of weighting factors.

The secondary path digital model $\hat{S}_{km}$ represents a transfer function between an actuator 2 and an error sensor 3. It may be determined offline (when there is no disturbing noise) in a calibration step, or online (in presence of the disturbing noise), through so-called online secondary path modelling techniques.

The transfer functions may as below be represented by FIR filters and the filtered and weighted reference signal $x'_{km}(n)$ may then be determined by a dot-product as $$x'_{km}(n)=\hat{s}'^{T}_{mk}(n)x(n)$$

where $$\hat{s}'_{mk}(n)=mp_m(n)\cdot kp_k(n)\cdot[\hat{s}_{mk,0}(n)\ \hat{s}_{mk,1}(n)\ \ldots\ \hat{s}_{k,L_s-1}(n)]^T$$

$$x(n)=[x(n)\ x(n-1)\ \ldots\ x(n-L_s+1)]^T$$

$x'_{km}(n)$ is the weighted and filtered reference signal x(n),
n is the current time step,
x(n) is a vector containing a time history of the reference signal x(n).
$\hat{S}'_{mk}(n)$ is a vector containing $L_s$ coefficients of the weighted and filtered FIR filter representing the secondary path $\hat{S}_{mk}$ between actuator k and error sensor m.

The filtered and weighted reference signal $x'_{km}(n)$ may be transmitted from the filtering and weighting device 9 to the filter update device 8. The error sensor weighting device 10 may be arranged to determine respective weighted error signals $e'_m(n)$ by applying respective error sensor weighting factors $mp_m(n)$ to the respective error sensor signal $e_m(n)$, and to transmit the weighted error signal(s) $e'_m(n)$ the to the filter update device 8. The filter update device 8 may be arranged to update the filter coefficients of the adaptive filter step wise by an iterative process using the expression:

$$w_k(n+1)=(1-\mu\gamma_k)w_k(n)-\mu\sum_{m=1}^{M}x'_{km}(n)e'_m(n)$$

wherein
μ is the step size
k represents the $k^{th}$ actuator
m represents the $m^{th}$ error sensor
$w_k(n)$ is a vector containing the current set of filter coefficients
$w_k(n+1)$ is a vector containing the updated set of filter coefficients
$x'_{km}(n)$ is a vector containing a time history of the weighted and filtered reference signal x(n).
$e'_m(n)$ is the weighted error signal from the $m^{th}$ error sensor.
$\mu\gamma_k$ is the leakage factor.

The adaptive algorithm unit 6 may apply the weighting factors to an LMS algorithm, an RLS algorithm or any other suitable algorithm.

A weighting factor for an error sensor 3/actuator 2 for a certain noise source operating condition may be determined from a set of predetermined relationships between signals c(n) representing different noise source operating conditions and corresponding predetermined weighting factors. Predetermined weighting factors may be determined by optimizing the method for various noise source operating conditions. The predetermined weighting factors may be stored together with the corresponding signals representing different noise source operating conditions, e.g. as a lookup table.

The pre-determined weighting factors for the actuator(s) 2 and error sensor(s) 3 may be saved as weighting matrices.

$$M_p(c)=\begin{bmatrix} mp_1(c) & \ldots & 0 \\ \vdots & \ddots & \vdots \\ 0 & \ldots & mp_m(c) \end{bmatrix}$$

$$K_p(c)=\begin{bmatrix} kp_1(c) & \ldots & 0 \\ \vdots & \ddots & \vdots \\ 0 & \ldots & kp_k(c) \end{bmatrix}$$

wherein mp and kp are participation factors for error sensors 3 and actuators 2 respectively and c represents a variable vehicle operating condition, e.g. rpm, wheel speed or similar.

A weighting factor for an error sensor 3/actuator 2 for a certain noise source operating condition may be determined by interpolation, such as linear interpolation or other curve fitting technique, of stored weighting factors.

Below is an example with linear interpolation where the operating condition c(n) is between condition c0 and c1 and the actuators 2 and error sensors 3 have been updated with weighting (participation factors).

$$mp_m(n)=mp_m(c0)\cdot\left(1-\frac{c(n)-c0}{c1-c0}\right)+mp_m(c1)\cdot\left(1-\frac{c1-c(n)}{c1-c0}\right)$$

$$kp_k(n)=kp_k(c0)\cdot\left(1-\frac{c(n)-c0}{c1-c0}\right)+kp_k(c1)\cdot\left(1-\frac{c1-c(n)}{c1-c0}\right)$$

A weighting factor for an error sensor 3/actuator 2 may be determined as a function of a predetermined weighting factor and a variable that represents the change of the vehicle operating condition.

The invention claimed is:

1. A method for reducing noise in at least one monitor position in a vehicle compartment by actively controlling the power of primary noise ($d_m(t)$) as sensed at two or more control positions in said vehicle compartment, the primary noise originating from a noise source transmitting noise (x(t)) through a respective primary path ($P_m$) to the respective control position, the method comprising:

arranging at least one actuator in the compartment, arranging an error sensor in each control position, arranging at least one adaptive filter ($w_k(n)$) per actuator, arranging an adaptive algorithm unit providing updated filter coefficients to the at least one adaptive filter ($w_k(n)$), arranging at least one reference sensor providing a reference signal x(n), coherent with the noise (x(t)) from the noise source, to the at least one adaptive filter ($w_k(n)$) and to the adaptive algorithm unit, applying the at least one adaptive filter ($w_k(n)$) to the reference signal (x(n)) to provide and transmit a drive signal ($y_k(n)$) to its respective actuator, arranging the at least one actuator to, as a response to the drive signal ($y_k(n)$), provide and transmit a respective secondary noise ($y_k(t)$) through a respective secondary path ($S_{km}$) between the actuator and the respective control position, arriving at the respective control position as a respective secondary anti-noise ($y'_m(t)$), arranging the error sensors to provide and transmit a respective error signal ($e_m(n)$), representing a sensed residual noise ($e_m(t)$) of the sensed primary noise and sensed secondary anti-noise, to the adaptive algorithm unit, arranging an actuator and error sensor weighting device to receive signal(s) (c(n)) representing noise source operating condition(s), to determine a set of weighting factors ($mp_m(n)$, $kp_k(n)$) for each actuator and error sensor, respectively, based on the signal(s) (c(n)) representing the noise source operating condition(s), and to transmit the determined set of weighting factors to the adaptive algorithm unit, and arranging the adaptive algorithm unit to, based on the received set of weighting factors, provide updated filter coefficients to the at least one adaptive filter ($w_k(n)$) to reduce the power of the residual noise ($e_m(t)$) sensed in at least one of the control positions, Wherein the adaptive algorithm unit comprises:

a filter update device, a filtering and weighting device arranged to filter the reference signal (x(n)) with a respective secondary path digital model ($\hat{S}'_{km}$) of the respective secondary path ($S_{km}$), update the filtered reference signal based on the received set of weighting factors, and to transmit the filtered and weighted reference signal ($x'_{km}(n)$) to the filter update device, an error sensor weighting device (10) arranged to determine respective weighted error signals ($e'_m(n)$) by applying respective error sensor weighting factors ($mp_m(n)$) to the respective error sensor signal ($e_m(n)$), and to transmit the weighted error signal(s) ($e'_m(n)$) the to the filter update device, wherein the filter update device is arranged to update the filter coefficients of the adaptive filter step wise by an iterative process using the expression:

$$w_k(n+1) = (1-\mu\gamma_k)w_k(n) - \mu\sum_{m=1}^{M} x'_{km}(n)e'_m(n)$$

wherein

μis the step size k represents the $k^{th}$ actuator m represents the $m^{th}$ error sensor $w_k(n)$ is a vector containing the current set of filter coefficients $w_k(n+1)$ is a vector containing the updated set of filter coefficients $x'_{km}(n)$ is a vector containing a time history of the weighted and filtered reference signal x(n)

$e'_m(n)$ is the weighted error signal from the $m^{th}$ error sensor and $\mu\lambda_k$ is the leakage factor.

2. The method of claim 1, wherein the weighting factors for the error sensors and actuator(s) for a certain noise source operating condition are determined from a set of predetermined relationships between signals (c(n)) representing different noise source operating conditions and corresponding predetermined weighting factors.

3. The method of claim 2, wherein the predetermined weighting factors for the error sensors and actuator(s) for a certain noise source operating condition are determined from predetermined spatial characteristics of a primary noise field in the compartment and predetermined spatial characteristics of a secondary anti-noise field in the compartment corresponding to a minimal residual noise level in at least one of the monitor positions.

4. The method of claim 2, wherein the predetermined weighting factors and signals (c(n)) representing different noise source operating conditions are stored as a lookup table.

5. The method of claim 2, wherein the weighting factors for error sensors and actuator(s) for a certain operating condition are determined by interpolation of stored weighting factors.

6. The method of claim 1, wherein the weighting factors for the error sensors and actuator(s) for a certain noise source operating condition are determined as a function of predetermined weighting factors and a variable that represents a change of the noise source operating condition(s).

7. The method of claim 1, wherein the signal(s) (c(n)) representing (a) noise source operating condition(s) are extracted from a computer bus/network of the vehicle, from one or more error sensors, from a tachometer signal, from one or more vibration sensors, or from the reference sensor used in the method.

8. The method of claim 1, wherein the adaptive algorithm unit applies the weighting factors to an LMS algorithm selected from a group comprising filtered-reference-LMS, leaky-filtered-reference-LMS, filtered-error-LMS, leaky-filtered-error-LMS, normalized-filtered-reference-LMS and normalized-leaky-filtered-reference-LMS.

9. The method of claim 1, wherein the adaptive algorithm unit applies the weighting factors to an RLS algorithm selected from a group comprising filtered-reference-RLS, leaky-filtered-reference-RLS, normalized-filtered-reference-RLS and normalized-leaky-filtered-reference-RLS.

10. The method of claim 1, wherein the reference signal (x(n)) is filtered with an adaptive FIR-filter $w_k$ as:

$$y_k(n)=w_k^T(n)\times(n)$$

where $$x(n)=[x(n)\ x(n-1)\ \ldots\ x(n-L_w+1)]^T$$

$$w_k(n)=[w_{k,0}(n)\ w_{k,1}(n)\ \ldots\ w_{k,L_w-1}(n)]^T$$

where $L_w$ is the number of coefficients of the adaptive filter and n is the current time step.

11. An active noise control system for reducing noise in at least one monitor position in a vehicle compartment by active control of the power of primary noise ($d_m(t)$ as sensed at two or more control positions in said vehicle compartment, the primary noise originating from a noise source transmitting noise (x(t)) through a respective primary path ($P_m$) to the respective control position, the system comprising:

at least one actuator arranged in the compartment, an error sensor arranged in each control position, at least one adaptive filter ($w_k(n)$) arranged per actuator, an adaptive algorithm unit arranged to provide updated filter coefficients to the at least one adaptive filter ($w_k(n)$), at least one reference sensor arranged to provide a reference signal x(n), coherent with the noise (x(t)) from the noise source, to the at least one adaptive filter ($w_k(n)$) and to the adaptive algorithm unit, wherein the at least one adaptive filter ($w_k(n)$) is arranged to be applied to the reference signal (x(n)) to provide and transmit a drive signal ($y_k(n)$) to its respective actuator;

wherein the at least one actuator is arranged to, as a response to the drive signal ($y_k(n)$), provide and transmit a respective secondary noise ($y_k(t)$) through a respective secondary path ($S_{km}$) between the actuator and the respective control position, arriving at the respective control position as a respective secondary anti-noise ($y'_m(t)$), and wherein the error sensors are arranged to provide and transmit a respective error signal (e(n)), representing a sensed residual noise ($e_m(t)$) of the sensed primary noise and sensed secondary anti-noise, to the adaptive algorithm unit;

an actuator and error sensor weighting device arranged to receive signal(s) (c(n)) representing noise source operating condition(s), to determine a set of weighting factors ($mp_m(n)$, $kp_k(n)$) for each actuator and error sensor, respectively, based on the signal(s) (c(n)) representing the noise source operating condition(s), and to transmit the determined set of weighting factors to the adaptive algorithm unit, wherein the adaptive algorithm unit is arranged to, based on the received set of weighting factors, provide updated filter coefficients to the at least one adaptive filter ($w_k(n)$) to reduce the power of the residual noise ($e_m(t)$) sensed in at least one of the control positions, Wherein the adaptive algorithm unit comprises:

a filter update device, a filtering and weighting device arranged to filter the reference signal (x(n)) with a respective secondary path digital model ($\hat{S}'_{km}$)of the respective secondary path ($S_{km}$), update the filtered reference signal based on the received set of weighting factors, and to transmit the filtered and weighted reference signal ($x'_{km}(n)$) to the filter update device, an error sensor weighting device (10) arranged to determine respective weighted error signals ($e'_m(n)$) by applying respective error sensor weighting factors ($mp_m(n)$) to the respective error sensor signal ($e_m(n)$), and to transmit the weighted error signal(s) ($e'_m(n)$) to the filter update device, wherein the filter update device is arranged to update the filter coefficients of the adaptive filter step wise by an iterative process using the expression:

$$w_k(n+1) = (1-\mu\gamma_k)w_k(n) - \mu\sum_{m=1}^{M} x'_{km}(n)e'_m(n)$$

wherein

μis the step size k represents the $k^{th}$ actuator m represents the $m^{th}$ error sensor $w_k(n)$ is a vector containing the current set of filter coefficients $w_k(n+1)$ is a vector containing the updated set of filter coefficients $x'_{km}(n)$ is a vector containing a time history of the weighted and filtered reference signal x(n)

$e'_m(n)$ is the weighted error signal from the $m^{th}$ error sensor and $\mu\lambda_k$ is the leakage factor.

12. A method of reducing the power of residual noise ($e_m(t)$) sensed in at least one control position arranged in a compartment of a motor vehicle, comprising operating an active noise control system of claim 11 in the motor vehicle.

13. The method of claim 12, wherein the motor vehicle is a road vehicle.

14. The method of claim 13, wherein the road vehicle is a car.

15. The method of claim 12, wherein the motor vehicle is an aircraft.

* * * * *